United States Patent [19]

Kadija

[11] 4,402,816

[45] * Sep. 6, 1983

[54] DIAPHRAGM STRUCTURE FOR ELECTROLYTIC CELLS FOR THE ELECTROLYSIS OF AQUEOUS SALT SOLUTIONS

[75] Inventor: Igor V. Kadija, Cleveland, Tenn.

[73] Assignee: Olin Corporation, New Haven, Conn.

[ * ] Notice: The portion of the term of this patent subsequent to Sep. 15, 1998, has been disclaimed.

[21] Appl. No.: 302,012

[22] Filed: Sep. 15, 1981

Related U.S. Application Data

[63] Continuation-in-part of Ser. No. 99,047, Nov. 30, 1979, Pat. No. 4,289,601, and Ser. No. 269,093, Jun. 2, 1981, abandoned.

[51] Int. Cl.[3] ..... C25B 13/08; C25B 13/06

[52] U.S. Cl. ..... 204/296

[58] Field of Search ..... 204/295, 296, 263

[56] References Cited

U.S. PATENT DOCUMENTS

| | | | |
|---|---|---|---|
| 4,093,533 | 6/1978 | Beaver et al. | 204/296 |
| 4,289,601 | 9/1981 | Kadija | 204/296 |

*Primary Examiner*—G. L. Kaplan
*Assistant Examiner*—Nam X Nguyen
*Attorney, Agent, or Firm*—James B. Haglind; Donald F. Clements

[57] ABSTRACT

A diaphragm for electrolytic cells for the electrolysis of aqueous salt solutions is comprised of an electrochemically active porous portion attached to an electrochemically inactive substantially fluid impervious portion. The electrochemically inactive portion is comprised of a fabric layer attached to a fluid impervious film layer. The electrochemically active porous portion is comprised of asbestos fibers, preferably deposited on a porous, lightweight thermoplastic fabric.

16 Claims, 4 Drawing Figures

10
12
14
16
18
20
22
24
26
28
30
32
33
34
35
36
37
39
40
42
44
46
50
52

DIAPHRAGM STRUCTURE FOR ELECTROLYTIC CELLS FOR THE ELECTROLYSIS OF AQUEOUS SALT SOLUTIONS

This invention relates to diaphragm-type electrolytic cells for the electrolysis of aqueous solutions of ionic compounds. More particularly, this invention relates to novel diaphragms for electrolytic diaphragm cells.

In an electrolytic diaphragm cell, the diaphragm represents the cell component which permits the cell to operate by producing gaseous and liquid products while providing, where necessary, separation of these products. Frequently, the diaphragm structure used covers one of the cell's electrodes, for example, the cathodes. The electrodes, in addition to having active areas at which electrolysis takes place, have sections which are electrolytically inactive. These areas permit the passage of electrolyte without, however, the production of desired products. In the case of the electrolysis of alkali metal chloride solutions, the electrolytically inactive areas permit the back migration of hydroxyl ions into the anode compartment increasing the amount of chlorate ion formed and resulting in a loss of current efficiency. Where the inactive areas have insufficient electrical field to protect metal electrodes by cathodic polarization, considerable corrosion of the electrodes in these inactive areas can occur. In addition, the inactive areas provide sites at which the porous diaphragm is loosened or weakened.

Thus these inactive areas require covering with a fluid impermeable material. In addition to being fluid impermeable, the impervious portion of the diaphragm structure should be compatible with and readily attached to the porous active portion of the diaphragm structure.

It is an object of the present invention to provide a diaphragm structure suitable for covering electrode structures.

Another object of this invention is to provide a diaphragm structure which is impervious to fluids at inactive areas of diaphragm-covered electrodes.

An additional object of the present invention is to provide a porous asbestos diaphragm which can be readily removed from an electrolytic cell.

A further object of the present invention is to minimize mechanical deterioration of catalytic coatings on cathodes during removal of the porous active portion of the diaphragm.

These and other objects of the invention are provided by a diaphragm for electrolytic cells for the electrolysis of aqueous salt solutions which comprises an electrochemically active porous portion comprised of asbestos fibers attached to an electrochemically inactive fluid impervious portion, the electrochemically inactive fluid impervious portion being comprised of a fabric layer attached to a fluid impervious film layer.

In the accompanying drawings, various embodiments of the invention are illustrated.

Figures 1, 2:
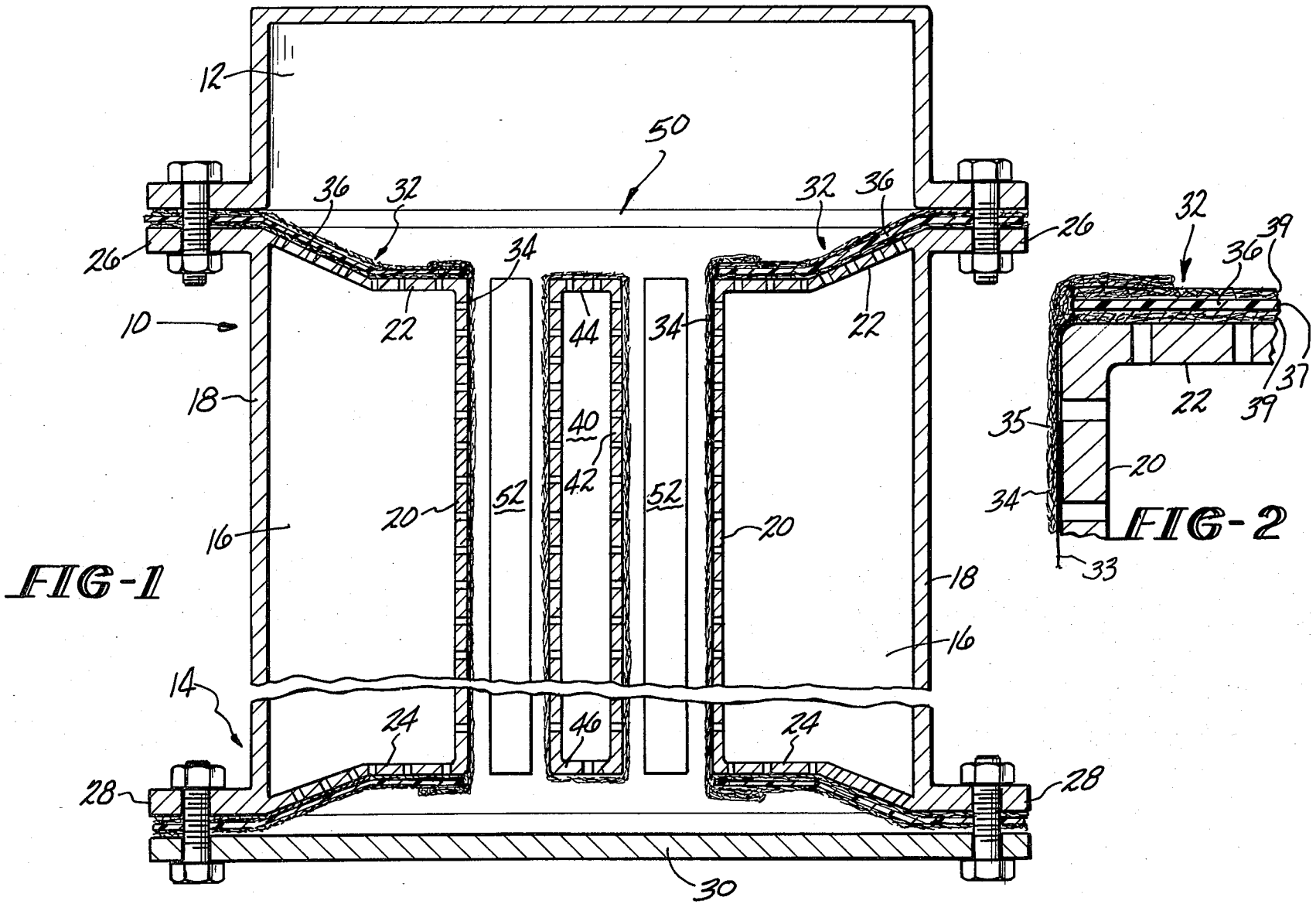
FIG. 1 shows an end view of a cross section of an electrolytic cell employing the novel diaphragm structure of the present invention.
FIG. 2 illustrates an enlarged partial section of FIG. 1.

FIG. 1 shows electrolytic cell 10 having cover 12 and cell body 14. Cell body 14 contains cathode assembly 50 comprised of external cathodes 16 and internal cathode 40. External cathode 16 having external walls 18, foraminous walls 20, foraminous top sections 22 and foraminous bottom sections 24. External walls 18 have upper flanges 26 and lower flanges 28 which are utilized to seal in a liquid tight manner cell body 14 to cover 12 and cell bottom 30. Internal cathode 40 has foraminous walls 42, foraminous top section 44 and foraminous bottom section 46. Anodes 52 are contained within cell body 14 and are inserted between and spaced apart from cathodes 16 and 40.

Diaphragm structure 32 is comprised of porous sections 34 and impervious sections 36. Foraminous walls 20 and 42 are covered with porous sections 34 of diaphragm structure 32. Foraminous top sections 22 and 44 and foraminous bottom sections 24 and 46 are covered by impervious sections 36 of diaphragm structure 32. Porous sections 34 are attached to impervious section 36. Impervious portions 36 are extended to cover upper flanges 26 and bottom flanges 28 as a gasket material.

FIG. 2 presents an enlarged section of FIG. 1 showing a portion of foraminous wall 20 covered by porous section 34 of diaphragm structure 32, and a portion of foraminous top section 22 covered by impervious section 36 of diaphragm structure 32. Porous section 34 is comprised of porous fabric 33, in contact with foraminous wall 20, and asbestos fibers 35 deposited on porous fabric 33. Porous fabric 33 is attached to impervious section 36 and asbestos fibers 35 are deposited along the end portion of impervious section 36. Impervious section 36 is comprised of film layer 37 bonded to fabric layers 39.

Figure 3:
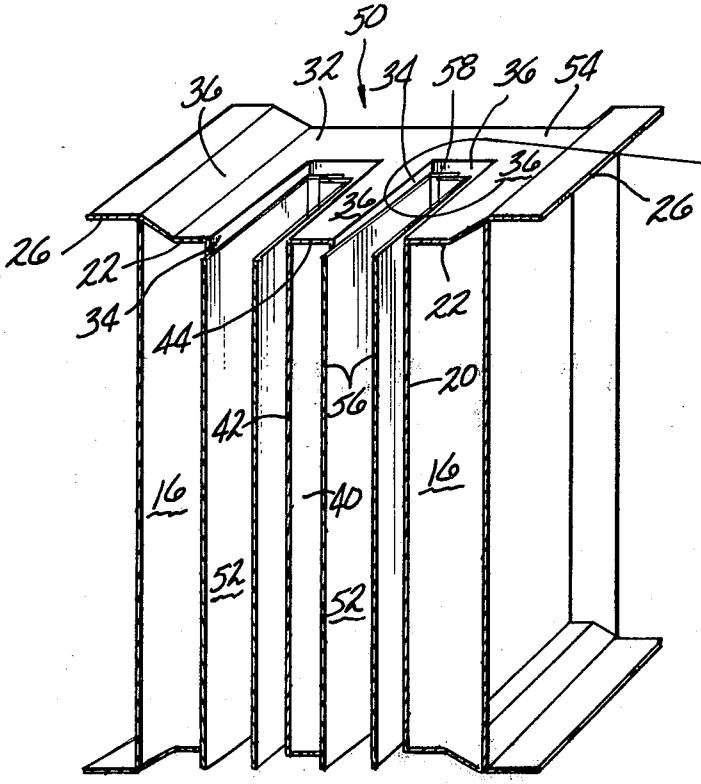
FIG. 3 represents a perspective view of a cathode section covered by an embodiment of the diaphragm structure of the present invention.

FIG. 3 shows a perspective view of cathode assembly 50 having external cathode 16 and internal cathodes 40 connected by cell wall 54. Anodes 52 are positioned between external cathode 16 and internal cathode 40. Anodes 52 have electrochemically active surfaces 56 and electrochemically inactive end sections 58. Anode posts (not shown) supply electric current to electrochemically active surfaces 56. Diaphragm structure 32 completely covers cathodes 16 and 40; with impervious sections 36 covering upper flanges 26, foraminous top sections 22 and 44 and vertical sections of cathodes 16 and 40 opposite and adjacent to electrochemically inactive end portions 58 of anodes 52. Porous sections 34 cover foraminous walls 20 and 42 opposite electroactive surfaces 56 of anodes 52.

Figure 4:
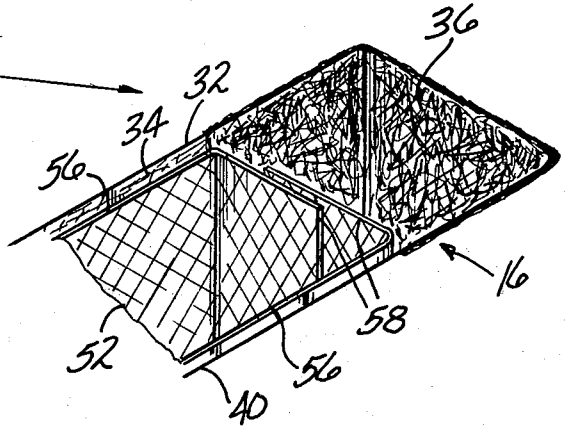
FIG. 4 depicts an enlarged partial section of FIG. 3.

FIG. 4 illustrates an enlarged section of FIG. 3 showing a portion of vertical section of cathode 16 covered by impervious section 36 opposite the electrochemically inactive end section 58 of anode 52.

The novel diaphragm structures of the present invention are comprised of a porous section and a substantially fluid impervious section.

The porous section is a fibrous structure comprised of asbestos fibers, formed, for example, by depositing fibers of asbestos on the outer surfaces of foraminous metal electrodes, such as the cathodes. The electrodes are immersed in a slurry of the fibers and a diaphragm formed by vacuum deposition. In addition to the fibers, the slurries may contain thermoplastic resins, including halocarbon polymers such as vinyl fluoride, vinylidene fluoride, trifluoroethylene, perfluoroethylene, vinylidene chloride, chlorotrifluoroethylene, and copolymers, for example, of olefins and haloolefins, i.e., of ethylene and chlorotrifluoroethylene. The fibers and resin particles, where present, are sucked onto the outer surface of the foraminous electrode until a diaphragm of the desired thickness is formed. After discontinuing the suction and removing the electrode from the slurry, water is removed, for example, by heating at temperatures up to about 100° C. for several hours. The electrode is then heated at higher temperatures, for example, up to about 350° C. for a short period to complete the diaphragm fabrication.

In a preferred embodiment, the porous section of the diaphragm comprised of the fibrous structure is formed by depositing the fibers on a porous lightweight fabric produced from a thermoplastic resin.

The porous fabric may be any suitable cloth having a weight in the range of from about 50 to about 500, and preferably from about 150 to about 300 grams per square meter. Porous lightweight fabrics which may be used include those produced from monofilaments or multifilaments. Suitable examples include scrim fabrics and napped fabrics. A preferred embodiment is a napped fabric having a smooth surface which is placed in contact with the electrode surface and a napped or fuzzy surface onto which the fibers are deposited.

Depositing the asbestos fibers onto a porous lightweight fabric simplifies the removal of the porous section of the diaphragm structure to replace the asbestos fibers. Normally, the asbestos mat is removed by water blasting, i.e. directing water under high pressure against the asbestos mat. Where the asbestos is deposited on a cathode having a catalytic coating, water blasting results in considerable damage to and loss of the active coating by erosion. This erosion significantly reduces the cathode life and increases electrode costs.

Where the asbestos mat is formed by deposition of asbestos fibers onto the porous lightweight fabric, the mat can be removed by peeling the porous section comprised of the porous fabric and asbestos mat off the cathode as a unit. This removal procedure significantly reduces the loss of the active catalytic coating and extends the life of the cathode.

The impervious portion of the diaphragm structure has at least two layers. One layer is an impervious film of a synthetic thermoplastic resin. Examples of suitable synthetic thermoplastic resins include halogenated polyolefins, such as polyvinyl chloride, polyvinylidene chloride, polytetrafluoroethylene, fluorinated ethylene-propylene (FEP), polychlorotrifluoroethylene, polyvinyl fluoride, polyvinylidene fluoride, polymerized perfluoroalkyls having the formula $CF_2CF_2CFO(CnF_{2n-1})CF_2CF_2$, where n is from 1 to about 10, and copolymers thereof, where the halogens are chlorine or fluorine.

The thermoplastic film layer may be any suitable thickness, for example, from about 1 to about 25 mils.

A preferred thermoplastic film is that which is available commercially as an "activated" film.

The second layer of the impervious portion of the diaphragm structure is a thermoplastic fabric material. Suitable fabrics for the impervious portion of the diaphragm structure include felt fabrics, nonwoven fabrics and napped fabrics, with felt fabrics and napped fabrics being preferred. Fabric layers are preferably those having a light weight, for example, from about 140 to about 575 grams per square meter.

Materials which are suitable for use in the fabric layer of the impervious portion of the diaphragm structure as well as for the porous fabric used to support the asbestos fibers include thermoplastic materials such as polyolefins which are polymers of olefins having from about 2 to about 6 carbon atoms in the primary chain as well as their chloro- and fluoro- derivatives.

Examples of suitable polyolefin materials used as materials of construction of the fabric layer include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride, and copolymers of ethylene-chlorotrifluoroethylene.

Preferred olefins include the chloro- and fluoro-derivatives such as polytetrafluoroethylene, fluorinated ethylene-propylene (FEP), polychlorotrifluoroethylene, polyvinyl fluoride, and polyvinylidene fluoride.

Also suitable are polyaromatic compounds such as polyarylene compounds. Polyarylene compounds include polyphenylene, polynaphthylene and polyanthracene derivatives. Preferred are polyarylene sulfides such as polyphenylene sulfide or polynapthylene sulfide.

In selecting materials for the impervious film layer and fabric layer of the impervious portion of the diaphragm structure, thermoplastic materials in the film layer preferably have a lower melting point to permit bonding to the fabric layer, for example, by heat sealing at temperatures which will not thermally damage the fabric layer.

In a preferred embodiment, the impervious portion of the diaphragm structure is comprised of two layers of fabric material separated by the film layer. A suitable example comprises a film layer of fluorinated ethylene-propylene placed between two layers of a polytetrafluoroethylene felt fabric. The layers may be bonded, for example, by sealing with energy forms such as heat or ultrasonic vibrations.

By applying, for example, heat and pressure, the impervious film is melted to the extent that it allows partial incorporation of the fibers of the fabric. This incorporation of fibers into the impervious film layer improves the mechanical properties of the film and strengthens the impervious layer.

When bonding the fabric layer to the impervious film layer, suitable temperatures are those from about 100° C. to those at which the thermoplastic fabric suffers minimal thermal decomposition. Preferred temperatures are those in the range from about 200° to about 300° C. Suitable pressures are those in the range of from about 0.05 to about 14, and preferably from about 1.4 to about 10.5 kilograms per square centimeter.

To form the complete diaphragm structure, the substantially fluid impervious portion is placed on the electrochemically inactive portions of the cathode. The cathode structure is then immersed in the slurry of asbestos fibers and the porous section of the diaphragm formed by vacuum deposition as described above. During deposition, asbestos fibers are permitted to deposit on the substantially impervious portion at selected locations to form junctions with the substantially impervious portions of the diaphragm structure. Bonding of the asbestos fibers to the substantially impervious portion is completed during the drying and curing of the porous section of the diaphragm.

Where the asbestos fibers are deposited on a porous fabric, the porous fabric is placed on the electrochemically active surfaces of the cathode and attached to the substantially fluid impervious sections by any suitable means such as sewing, heat sealing or with an adhesive.

The impervious portion of the diaphragm may also be used independently of the porous section as a sealing composition. As an impervious sealing composition, it is flexible and sufficiently elastic to be used, for example, as a gasket material in any cell areas where fluid-tight seals are required, as shown in FIG. 1.

Other sealing materials such as neoprene rubber or ethylene-propylene-diene terpolymers (EPDM) may be used together with the impervious sealing composition as these materials can be readily bonded together, for example, with an adhesive.

Improved sealing properties may be obtained by coating the fabric layers of the impervious sealing composition with silicone rubber or polysulfides.

Electrolytic cells in which the diaphragm structure of the present invention may be used are those, for example, which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode compartment containing of plurality of foraminous metal anodes, a cathode compartment having a plurality of foraminous metal cathodes with the novel diaphragm separating the anode compartment from the cathode compartment. Suitable electrolytic cells include, for example, those types illustrated by U.S. Pat. Nos. 1,862,244; 2,370,087; 2,987,463; 3,247,090; 3,477,938; 3,493,487; 3,617,461; 3,462,604; and 3,898,149.

The following Examples are presented to illustrate more fully the invention without any intention of being limited thereby. All parts and percentages are by weight unless otherwise indicated.

EXAMPLE 1

A cathode assembly of the type illustrated in FIG. 3 was covered at the electrochemically inactive areas with two layers of a polytetrafluoroethylene felt fabric bonded to an intermediate layer of fluorinated ethylene-propylene (FEP) film as the substantially fluid impervious portion.

The substantially fluid impervious portion was formed by inserting a layer of an impervious fluorinated ethylene-propylene film (Livingston Coatings, Inc. activated film) about 0.015 centimeter thick between two layers of polytetrafluoroethylene felt fabric (weight—283.5 grams per square meter).

Fabrication of the impervious layered structure was completed by heat sealing the structure at a temperature of 275° C. under a pressure of 122 psi.

The electrochemically active areas of the cathode were covered by a porous polytetrafluoroethylene fabric (Goretex ® monofilament scrim). The porous fabric was sewn to the substantially fluid impervious portions at adjoining areas. The cathode assembly was immersed in a tank containing a slurry of asbestos fibers in cell liquor containing 13.5 percent by weight of NaOH and 12.2 percent by weight of NaCl. Admixed with the asbestos fibers was 5 percent by weight of an ethylene-chlorotrifluoroethylene copolymer resin (E-CTFE). A vacuum of 460 torr was imposed for a period of about 10 minutes to deposit asbestos fibers on the porous fabric covering the electrochemically active areas of the cathode section and the portions of the substantially fluid impervious sections adjoining electrochemically active areas of the cathode. After the asbestos fibers had been deposited as a mat on the porous fabric to form the porous sections of the diaphragm structure, the vacuum was discontinued and the cathode section removed from the slurry tank. The diaphragm structure was dried in an oven by heating at a temperature of 100° C. for 1 hour. Curing was completed by gradually heating the diaphragm structure up to 275° C. and maintaining this temperature for 1 hour.

The impervious portions served as the gasket material along the flanges where the cell cover and cell bottom were attached to the cell body. These areas of the impervious portions were coated with silicone rubber prior to bolting on the cell cover and the cell bottom.

The cathode assembly was installed in an electrolytic cell of the type shown in FIG. 1.

The cell was equipped with ruthenium oxide coated titanium mesh anodes and the anode compartment was filled with sodium chloride brine at a pH of 12, a concentration of 300±5 grams per liter of NaCl and a temperature of 90° C. Electrolysis was conducted employing a current density of 2.0 kiloamps per square meter of anode surface. The cell was operated for a period of 45 days at a cell voltage of 3.1–3.2 volts and a cathode current efficiency of 93.5±2.1 percent to produce chlorine gas, hydrogen gas, and a caustic solution containing 140–150 grams per liter of NaOH. No leakage of fluids occurred in the flange area where the substantially fluid impervious section served as a gasket.

The porous section was readily removed by peeling off the porous section (the scrim fabric and the asbestos mat) as a unit from the cathode while applying water under a pressure of 0.56 kilograms per centimeter.

EXAMPLE 2

The procedure of Example 1 was repeated identically with the exception that a napped multifilament polytetrafluoroethylene fabric (226.8 grams per square meter) was used as the support for the asbestos fibers. The smooth side of the fabric was placed against the cathode surface and the asbestos fibers deposited on the napped surface. The napped fabric was attached to the substantially fluid impervious section by sewing. The cell was operated for a period of 30 days during which the cell voltage was 3.3–3.35 volts at a current density of 2 $KA/m^2$. Cathode current efficiency was 92.8±2.5 percent in producing a catholyte liquor having a NaOH concentration of 136–148 grams per liter.

Following the period of operation, the porous section of the diaphragm structure was peeled off the cathode structure.

What is claimed is:

1. A diaphragm for electrolytic cells for the electrolysis of aqueous salt solutions which comprises an electrochemically active porous portion comprised of asbestos fibers attached to an electrochemically inactive substantially fluid impervious portion, said electrochemically inactive substantially fluid impervious portion being comprised of a fabric layer attached to a fluid impervious film layer.

2. The diaphragm of claim 1 in which said fluid impervious film layer is comprised of a fluorinated olefin selected from the group consisting of polytetrafluoroethylene, fluorinated ethylene-propylene (FEP), polychlorotrifluoroethylene, polyvinylfluoride, and polyvinylidene fluoride.

3. The diaphragm of claim 2 in which said porous portion is comprised of asbestos fibers deposited on a porous fabric.

4. The diaphragm of claim 3 in which said porous fabric is a napped fabric.

5. The diaphragm of claim 3 in which said porous fabric is a scrim fabric.

6. The diaphragm of claim 4 or claim 5 in which said impervious layer is comprised of two fabric layers bonded to an intermediate fluid impervious film layer.

7. The diaphragm of claim 3 or claim 6 in which said fluid impervious fluid layer is comprised of fluorinated ethylene-propylene (FEP).

8. The diaphragm of claim 7 in which said fabric layer of said substantially fluid impervious portion is selected from the group consisting of a felt fabric and a napped fabric.

9. The diaphragm of claim 1 in which said fabric layer attached to said fluid impervious film layer is comprised of thermoplastic materials selected from the group consisting of polyolefins, polyarylene sulfides, and mixtures thereof.

10. The diaphragm of claim 9 in which said polyolefin is selected from the group consisting of olefins having from 2 to about 6 carbon atoms and their chloro- and fluoro-derivatives.

11. The diaphragm of claim 9 in which said polyarylene sulfide is polyphenylene sulfide or polynaphthylene sulfide.

12. The diaphragm of claim 3 in which said porous fabric is comprised of a polyolefin selected from the group consisting of olefins having from 2 to about 6 carbon atoms and their chloro- and fluoro-derivatives.

13. The diaphragm of claim 12 in which said porous fabric is polytetrafluoroethylene.

14. In an electrolytic cell for the electrolysis of aqueous salt solutions which comprises a cell body; an anode compartment containing at least one anode; a cathode compartment containing at least two cathodes, said anode being inserted between and spaced apart from said cathodes; a diaphragm separating said anode compartment from said cathode compartment; inlets for introducing fluids into said anode compartment and said cathode compartment; outlets for removing fluids from said anode compartment and said cathode compartment; means for introducing electric current and removing electric current from said cell body, the improvement which comprises:

said diaphragm being comprised of an electrochemically active porous portion comprised of asbestos fibers attached to an electrochemically inactive substantially fluid impervious portion, said electrochemically inactive substantially fluid impervious portion being comprised of a fabric layer attached to a fluid impervious film layer.

15. The electrolytic cell of claim 14 in which said fluid impervious film layer is comprised of a fluorinated olefin selected from the group consisting of polytetrafluoroethylene, fluorinated ethylene-propylene (FEP), polychlorotrifluoroethylene, polyvinylfluoride, and polyvinylidene fluoride.

16. The electrolytic cell of claim 15 in which said porous portion is comprised of asbestos fibers deposited on a porous fabric, said porous fabric being in contact with said cathodes.

* * * * *

UNITED STATES PATENT AND TRADEMARK OFFICE

CERTIFICATE OF CORRECTION

PATENT NO. : 4,402,816

DATED : September 6, 1983

INVENTOR(S) : Igor V. Kadija

It is certified that error appears in the above-identified patent and that said Letters Patent is hereby corrected as shown below:

In Column 5, line 26, delete "of" (first occurrence) and insert --a--.

In Column 7, Claim 7, line 2, delete "fluid" and insert --film--.

Signed and Sealed this

*Twenty-second* Day of *November 1983*

[SEAL]

*Attest:*

GERALD J. MOSSINGHOFF

*Attesting Officer*

*Commissioner of Patents and Trademarks*